US006374969B1

(12) United States Patent
Young

(10) Patent No.: US 6,374,969 B1
(45) Date of Patent: Apr. 23, 2002

(54) TRUCK ASSEMBLY FOR LUGGAGE

(75) Inventor: David Young, Taipei (TW)

(73) Assignee: G&A Trading Company, City of Industry, CA (US)

( * ) Notice: Subject to any disclaimer, the term of this patent is extended or adjusted under 35 U.S.C. 154(b) by 0 days.

(21) Appl. No.: 09/481,920

(22) Filed: Jan. 13, 2000

(51) Int. Cl.[7] ..... A45C 5/14
(52) U.S. Cl. ..... 190/18 A; 280/47.26
(58) Field of Search ..... 190/18 A, 18 R, 190/39, 115; 280/37, 47.31, 47.37, 655, 47.26

(56) References Cited

U.S. PATENT DOCUMENTS 3,809,231 A * 5/1974 Palma et al. ..... 190/18 A
5,163,539 A * 11/1992 Yang ..... 190/18 A
5,323,886 A * 6/1994 Chen ..... 190/18 A
5,374,073 A * 12/1994 Hung-Hsin ..... 190/18 A
5,393,079 A * 2/1995 Wang ..... 190/18 A
5,396,974 A * 3/1995 Pedlar
5,433,461 A * 7/1995 Chang ..... 190/18 A
5,524,737 A * 6/1996 Wang ..... 190/18 A
5,575,361 A * 11/1996 Chou ..... 190/18 A
5,590,748 A * 1/1997 Chang ..... 190/18 A

* cited by examiner

*Primary Examiner*—Stephen P. Garbe
*Assistant Examiner*—Lien Ngo
(74) *Attorney, Agent, or Firm*—Lyon & Lyon LLP

(57) ABSTRACT

A truck assembly and luggage associated therewith includes a base panel, a bottom panel and side panels. The bottom panel and the side panels intersect the base panel at a mutual edge. Two wheel cavities extend through the base panel and the bottom panel and across the mutual edge to receive wheels. Axles are positionable in mounting panels to each side of each wheel cavity. The mounting panels include semicircular mounting surfaces and access passages thereto. Mounting caps include plates and extended bosses with cap surfaces forming segments of a cylinder to cooperate with the semicircular mounting surfaces to form cylindrical mountings. Axles are positioned in the cylindrical mountings and in turn rotatably mount the wheels. Reusable fasteners in the form of screws hold the plates to the base panel of the truck assembly. A slidably mounted handle associated with the luggage case is positioned to be parallel to the bottom panel and at the far side of the case from the base panel.

10 Claims, 1 Drawing Sheet

TRUCK ASSEMBLY FOR LUGGAGE

BACKGROUND OF THE INVENTION

The field of the present invention is wheeled luggage.

Wheeled luggage has become increasingly popular as a way to facilitate travel. Such luggage frequently has trucks which are wholly inadequate to the task. The wheels are typically quite small to facilitate convenience and a compact design. As a result, such wheels often are unable to withstand the substantial shock loads resulting from a heavy burden being drawn over abrupt curbs and rough surfaces. The practice of many travelers is also to use such wheeled luggage as a carrier for other pieces of luggage, packages and the like. Naturally, the burden is further increased.

Typically wheeled luggage includes truck assemblies that are permanently affixed to the case. Rivets are frequently employed and the mounting is inappropriately configured or oriented to receive the shocks and loads imposed during use. Downtime and resulting inconvenience to the user often occurs.

SUMMARY OF THE INVENTION

The present invention is directed to truck assemblies for luggage and the combination thereof. The truck assemblies include a base panel, a bottom panel which intersects with the base panel at a mutual edge and at least two wheel cavities extending across that mutual edge. Mounting cavities are located to the sides of each wheel cavity to receive an axle of a wheel positioned within the wheel cavity.

In a first separate aspect of the present invention, the truck assembly includes mounting caps fixable to the base panel to close the mounting cavities. These mounting caps include reusable fasteners.

In a second separate aspect of the present invention, the mounting caps include extended bosses which are positionable in excess passages associated with the mounting cavities. The mounting cavities and the extended bosses define cylindrical mountings when assembled to receive wheeled axles.

In a third separate aspect of the present invention, the mounting caps are defined as plates with extended bosses extending from one side of the plates. Reusable fasteners include screws which extend through the plates and are fixable to the base panel. Recesses may be provided in the base panel to receive the mounting plates.

In a fourth separate aspect of the present invention, any of the foregoing aspects are contemplated to be employed in combination with luggage including a case and a handle mounted to the case on the other side from the base.

Accordingly, it is an object of the present invention to provide improved luggage truck assemblies. Other and further objects and advantages will appear hereinafter.

DETAILED DESCRIPTION OF THE PREFERRED EMBODIMENT

Figure 2:
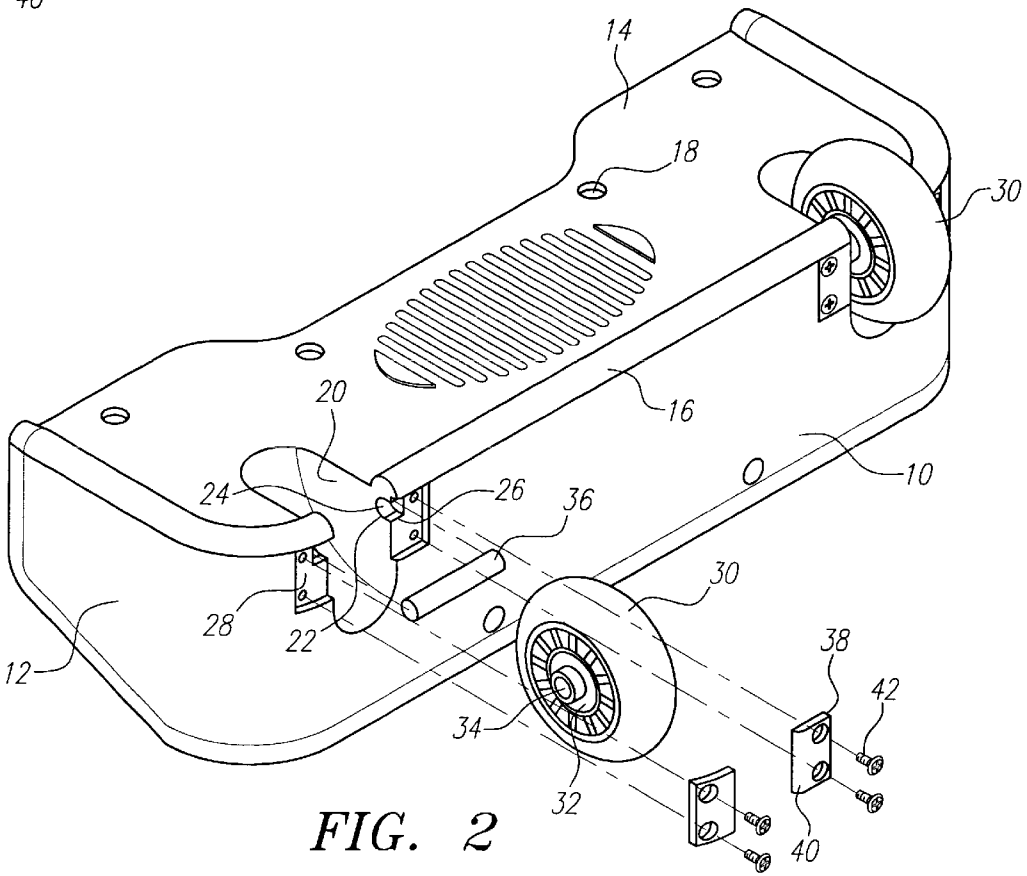
FIG. 2 is an exploded perspective view of a truck assembly.
Figure 1:
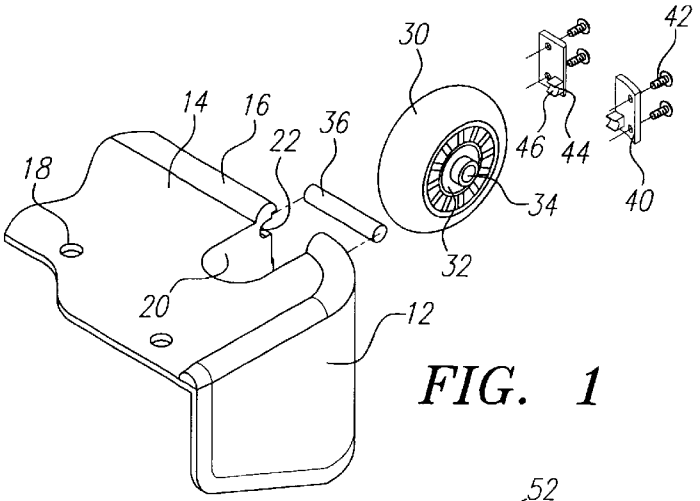
FIG. 1 is a perspective exploded assembly view of a portion of a truck assembly.

Turning in detail to the drawings, a truck assembly is illustrated which includes a base panel 10 which is shown to extend continuously to right and left hand side panels 12. A bottom panel 14 intersects the base panel 10 and the side panels 12 at a mutual edge. A strengthening bead 16 extends along the mutual edge. These panels 10, 12 and 14 are contemplated to be integrally formed of impact resistant plastic. Mounting holes 18 are strategically arranged about the panels as well.

Two wheel cavities 20 extend through the base panel 10 and the bottom panel 14 across the mutual edge at the bead 16. The cavities include a back wall integral with the panels sized to accommodate wheels with an appropriate clearance. Mounting cavities 22 are arranged to either side of each of the wheel cavities 20. The mounting cavities 22 include semicircular mating surfaces 24 with access passages 26 extending to the semicircular mating surfaces 24. These mounting cavities 22 extend inwardly through the base panel 10 and are open toward the wheel cavities 20. Recesses 28 are arranged in the base panel 10 around the openings of the mounting cavities 22.

Wheels 30 are positioned within the wheel cavities 20. The wheels 30 may include bearings 32 and hubs 34. Axles 36 extend through the hubs 34 to rotatably mount the wheels 30. The axles 36 are positioned in the mounting cavities 22 with each end of the axles 36 being constrained therein.

Mounting caps 38 include plates 40 which are positioned in the recesses 28 of the base panel 10. The plates 40 fill the recesses 28 such that they are properly positioned for receipt of fasteners. Reusable screws 42 are employed to extend through the plates 40 into threaded engagement with the base panel 10. The mounting caps 38 include extended bosses 44 which extend from one side of the plates 40. These bosses 44 include a cap surface 46 forming a segment of a cylinder. The cap surfaces 46 combine with the semicircular mating surfaces 24 to define cylindrical mountings. The extended bosses 44 fit closely within the access passages 26 so as to exhibit locational stability.

Figure 3:
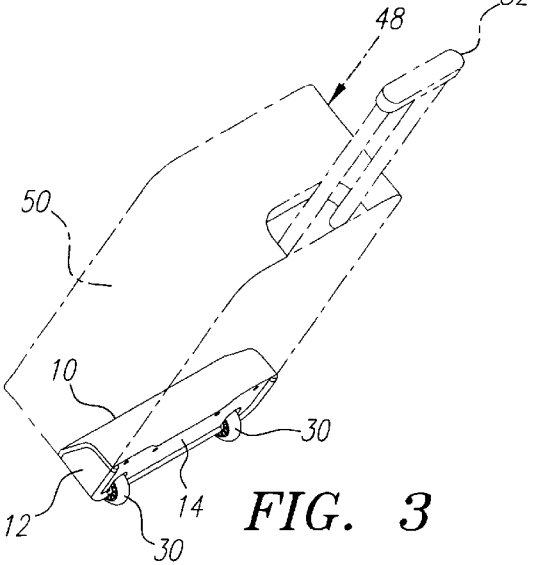
FIG. 3 is an assembly view of the truck assembly with luggage shown in phantom.

As illustrated in FIG. 3, the truck assembly is shown to be assembled with a piece of luggage 48. The luggage 48 is shown to include a case 50 with a slidably mounted handle 52. The handle is substantially parallel to the bottom panel 14 such that the handle 52 is on the other side of the case 50 from the base panel 10. With this arrangement, the proper orientation of the entire assembly locates the axles 36 to bear against the semicircular mating surfaces 24 where substantial strength can be provided to hold the wheel mountings. Yet, with the reusable fasteners 42, damaged wheels can be rapidly replaced.

Accordingly, an improved truck assembly and luggage associated therewith has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A truck assembly comprising a base panel;

a bottom panel intersecting the base panel at a mutual edge;

at least two wheel cavities, each cavity extending through the base panel and the bottom panel and across the edge;

a mounting cavity to each side of each wheel cavity;

axles positionable in the mounting cavities to extend across the wheel cavities;

wheels on the axles;

mounting caps fixable to the base panel to close the mounting cavities, respectively, with the axles in the mounting cavities, and including reusable fasteners.

2. The truck assembly of claim 1, the reusable fasteners including screws extending therethrough and fixable to the base panel.

3. The truck assembly of claim 1, the mounting cavities each including a semicircular mounting surface and an access passage, the mounting caps each including an extended boss positionable in the access passage and a cap surface forming a segment of a cylinder, the semicircular mounting surface and the cap surface forming a cylindrical mounting with the extended boss positioned in the access passage.

4. The truck assembly of claim 3, the mounting caps each further including a plate, the extended boss extending from one side of the plate, the reusable fasteners including screws extending through the plate and fixable to the base panel.

5. The truck assembly of claim 4, the base panel including recesses surrounding the mounting cavities, the plates filling the recesses.

6. Luggage comprising the truck assembly of claim 1;

a case, the truck assembly being affixed to the case;

a handle mounted to the case on the other side of the case from the base panel.

7. The luggage of claim 6, the handle being slidably mounted to extend substantially parallel to the bottom panel.

8. The luggage of claim 6, the reusable fasteners including screws extending therethrough and fixable to the base panel.

9. The luggage of claim 8, mounting caps each further including a plate, an extended boss extending from one side of the plate, and fasteners extending through the plate and fixable to the base panel.

10. The luggage of claim 9, the base panel including recesses surrounding the mounting cavities, the plates filling the recesses.

* * * * *